United States Patent [19]

Callahan et al.

[11] 4,320,816

[45] Mar. 23, 1982

[54] WINDOW PERCH

[76] Inventors: Phyllis M. Callahan; Emmanuel K. Christian; Josiah W. Christian, all of 1510 Columbia Rd., Washington, D.C. 20009

[21] Appl. No.: 199,194

[22] Filed: Oct. 21, 1980

[51] Int. Cl.[3] ..... A47L 3/02

[52] U.S. Cl. ..... 182/55; 182/60

[58] Field of Search ..... 182/53, 54, 55, 56, 182/57, 58, 59, 60, 61, 62, 150, 206, 106

[56] References Cited

U.S. PATENT DOCUMENTS

| | | | |
|---|---|---|---|
| 1,272,173 | 7/1918 | Acuin | 182/55 |
| 1,295,453 | 2/1919 | Edland | 182/55 |
| 1,458,744 | 6/1923 | Brewster | 182/58 |
| 2,184,457 | 12/1939 | Kruse | 182/55 |
| 2,925,139 | 2/1960 | Salas | 182/62 |
| 3,727,721 | 4/1973 | Kulesa | 182/62 |
| 4,029,173 | 6/1977 | Wakabayashi | 182/55 |
| 4,079,813 | 3/1978 | Ellison | 182/62 |

FOREIGN PATENT DOCUMENTS

| | | | |
|---|---|---|---|
| 1348994 | 12/1963 | France | 182/55 |

*Primary Examiner*—Reinaldo P. Machado
*Attorney, Agent, or Firm*—Eric P. Schellin

[57] ABSTRACT

There is disclosed a window perch so that access to the outside of a sash window may be had even though the window may be considerably above the ground. The perch does not depend on ground support, but on the contrary depends on the wall area located immediately below the window sill. The perch comprises a clamping arrangement that clamps to the stated wall area. Suitable bracket means extend normally to the outer wall portion of the stated wall area which carry a planar member upon which a workman may stand or may be seated. A safety railing is provided vertically displaced from the planar member which is suitably affixed to the planar member and the stated clamping arrangement. The perch is constructed in a manner so that it may be conveniently collapsed so that it may be more easily positioned and retrieved through the sash window and may be stored when not in use.

6 Claims, 7 Drawing Figures

WINDOW PERCH

BACKGROUND OF THE INVENTION

The present invention has for its background the various devices that permit relatively easy access to the outside of windows. Access to windows of a building is a necessary need in numerous occasions. For instance, windows need to be washed at relatively frequent intervals. The trim around windows will require painting from time to time. Also the need to caulk around windows or to replace and re-glaze window panes is something that will occur.

Various solutions to access to the outside of windows abound. For instance, scaffolding is popular but requires laborious set up procedures either of the ground supported type or of the cable roof top supported type. Of course, in some instances ladders may be employed but a ladder has limited uses. When dealing with sash windows, a simple expedient is for the worker to sit on the window sill with the body of the worker outside and the legs inside. This arrangement has limited applicability when attempting to paint the trim of windows for instance.

Therefore any arrangement that permits easy positioning and removability in the vicinity of the outside of the window and is of the type that will support the workman will be looked upon with favor by the industry.

SUMMARY OF THE INVENTION

The invention relates to a perch for a windowsill and the wall area thereunder which together support the perch and the worker thereon. The perch is constructed wherein it includes a clamping arrangement for clamping about the wall area located under the windowsill. The clamping arrangement takes the form of a large C-clamp which has means for gross adjustment and means for fine adjustment. The clamping arrangement has integrally attached to it an extension portion which causes a platform useful for standing upon by a workman when the perch is set for use. The platform is positioned externally of the building a short distance below the window. In order to prevent the workman from falling, a safety rail is positioned around the rail at a convenient height above the platform. A number of upstanding supports are provided between the platform and the railing.

The perch may be collapsed, i.e. folded, to permit set up and removal through the sash window. This is accomplished by strategically positioned pull pins. One set is located at the end of one brace of the platform which is pivotally mounted to one end portion of the stated C-clamp. Other pull pins are located to unlock the end portions of the railing from the C-clamp. The back railing supports are pivotable relative to the platform and relative to the railing. As the platform is also pivotable it folds arcuately upwardly while the railing is moved in a forward manner. The perch in the collapsed configuration permits withdrawal through the window for retrieval.

DETAILED DESCRIPTION OF THE INVENTION

Figure 6:
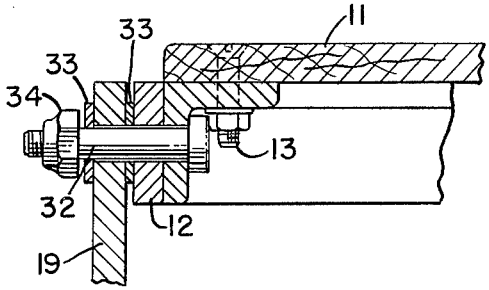
FIG. 6 is a fragmentary cross-sectional view taken along line 6—6 of FIG. 1.
Figure 3:
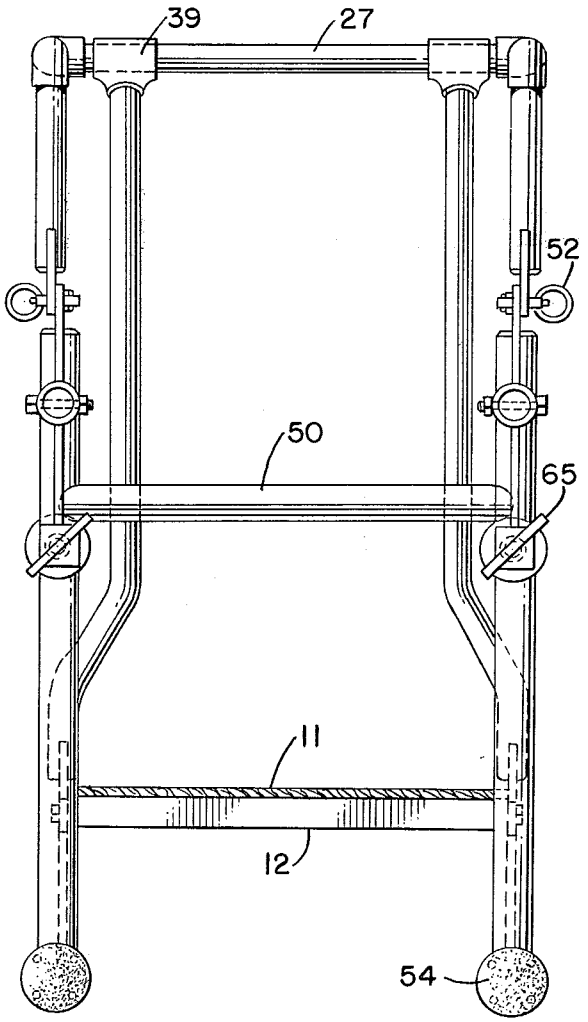
FIG. 3 is a front elevation of the perch of the present invention.
Figure 2:
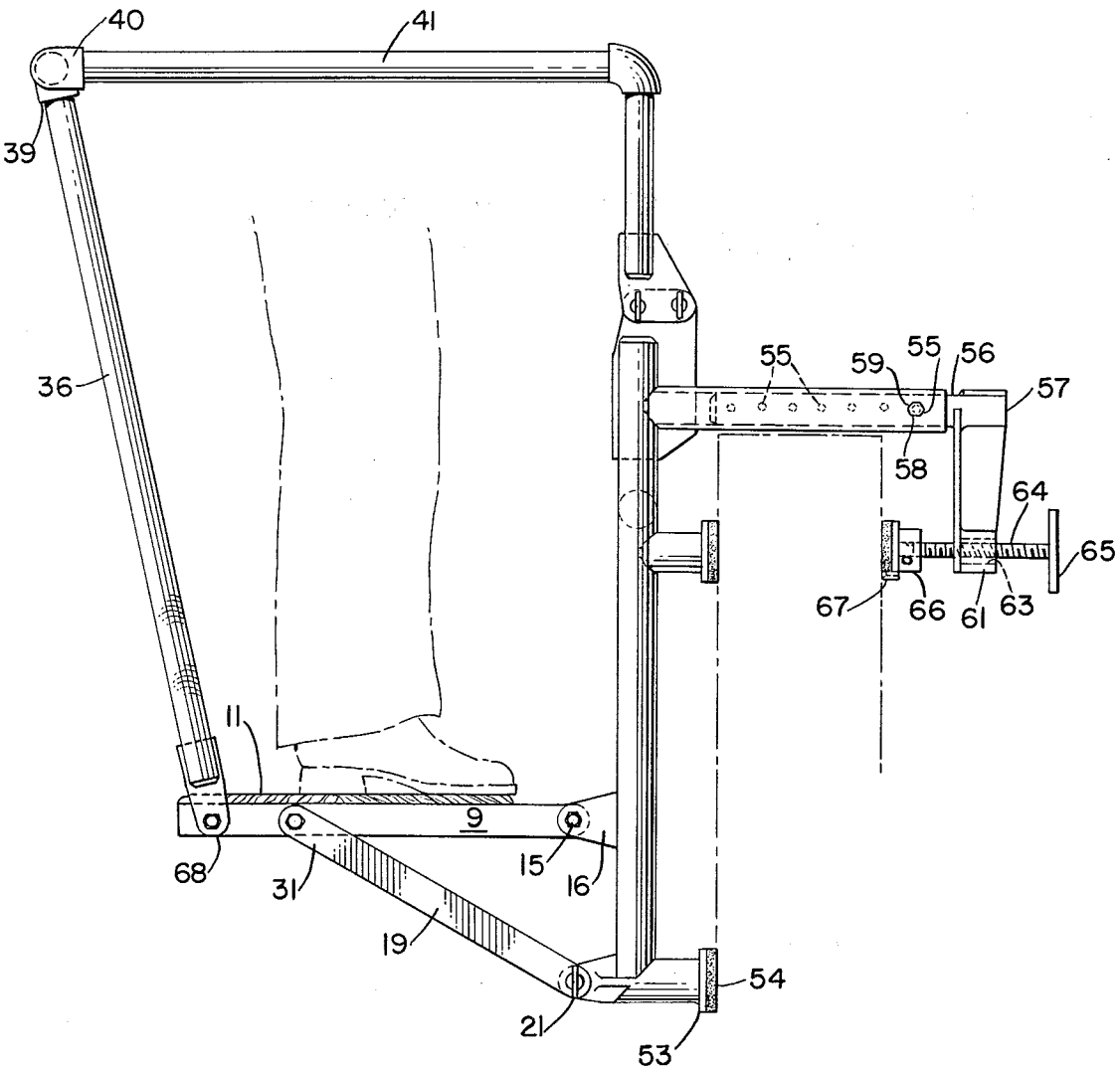
FIG. 2 is a side elevation of the perch of the present invention.
Figure 4:
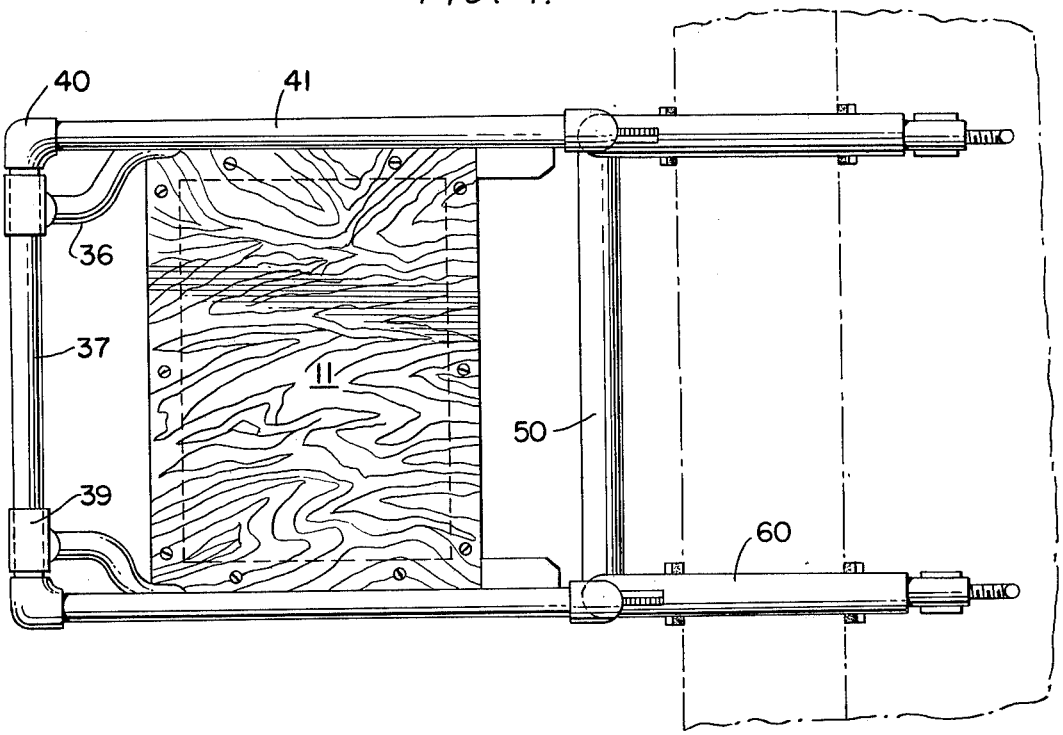
FIG. 4 is a top plan view of the perch of the present invention.

Now turning to the drawings the perch of the present invention is identified, generally, by reference numeral 10. The perch includes a relatively small rectangular platform 11 which may be constructed of wood or a metal of suitable thickness to support the weight of a workman as shown by FIG. 2. The platform is attached to upwardly facing metal frame 12 by a plurality of suitable nuts and bolts 13 as can be seen from FIG. 6, for instance. The frame 12 is provided at two sides 9 with forwardly extending portions 14. These forwardly extending portions 14 are pivotably received by nuts and bolts 15 to rearwardly extending ears 16 mounted near the bottom portion of each of upright standards 17. Each of the said standards 17 also have at the bottom terminus thereof rearwardly extending ears 18 to each of which upwardly extending braces 19 are pivotally removably mounted.

Figure 1:
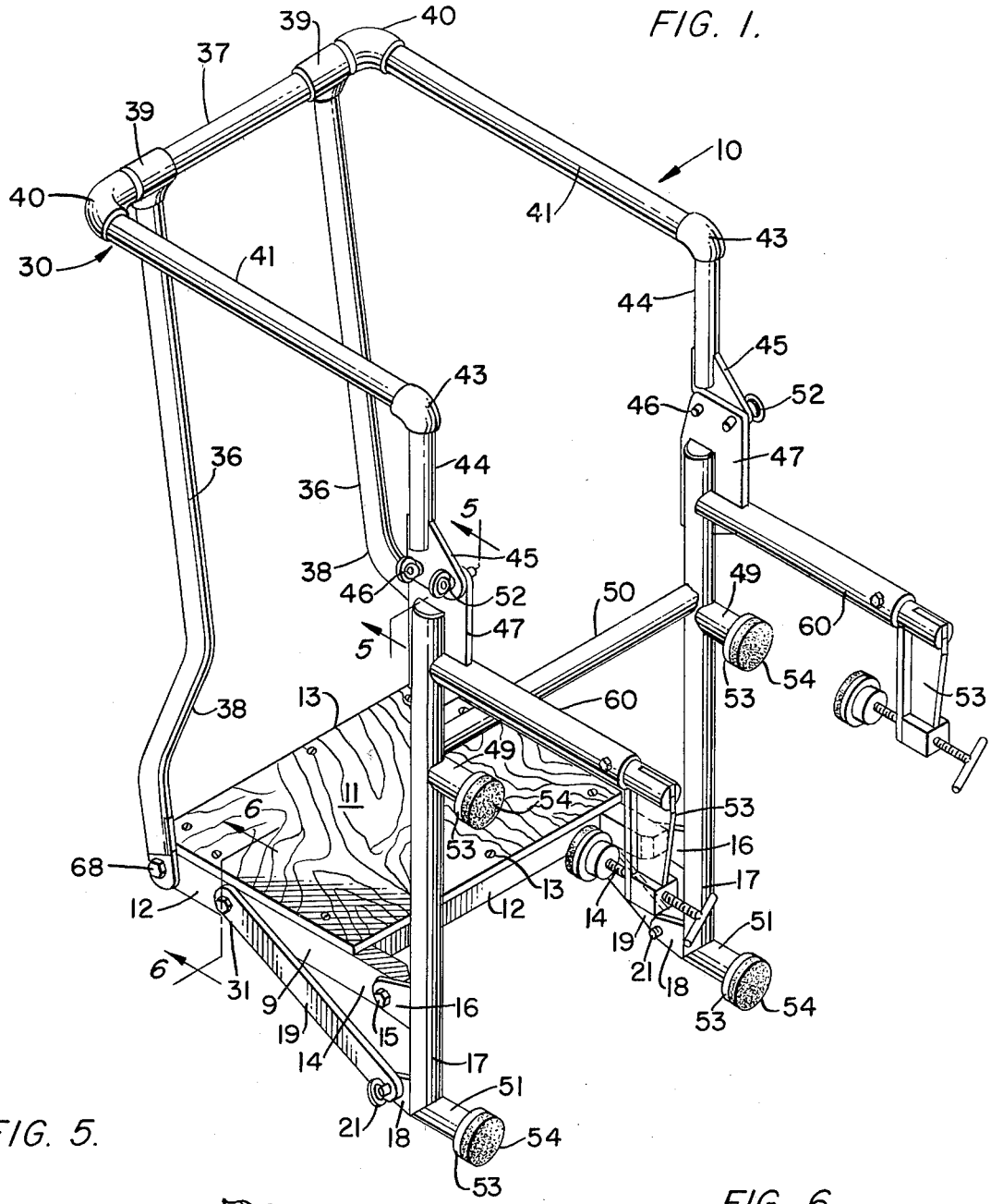
FIG. 1 is a perspective of the perch of the present invention.
Figure 5:
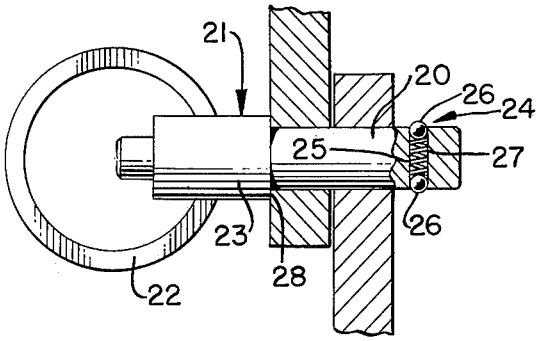
FIG. 5 is a fragmentary cross-sectional view taken along line 5—5 of FIG. 1.

The pivotting means occurs about pull ring rods 21 which are of conventional structure and are of the type shown in FIG. 5, that includes a ring 22 attached to enlarged portion 23 of the pull ring rod 21 that extends into a smaller diameter rod 20 having near its terminus a conventional ball spring combination 24 mounted in a bore 25 with two balls 26 secured at the openings of the bore 25 and urged oppositely radially outwardly by spring 27 to complete what amounts to a detend function to retain the pull ring rod 21 in place between a shoulder 28 produced by the enlarged portion 23 and the ball spring combination 24.

The other end portions 31 of the braces 19 are pivotally secured rearwardly beyond the midpoint of the sides 9 of frame 12 as by bolt 32 secured in a manner to provide suitable journalling with washers 33 interposed between the frame 12 and the brace 19 and between the brace and nut 34 of bolt 32. The assembly thereof can be seen in FIG. 6.

In order to protect a worker who may be standing on the platform 11 a system of railings 30 is provided. The rear uprights 36 as shown in the Figures extend upwardly to hand rail 37 and give partial support thereto. The bottom of the rear uprights 36 are pivotably secured to the rear side of the frame 12 of the platform 11. The uprights 36 have incline portions 38 so that there is an offset inwardly whereby the perch of the present invention can be more conveniently collapsed as will be seen later.

The uprights 36 terminate in pivotable T-element 39. The corners of the railing comprise elbows 40, to which are attached horizontally extending railings 41 to provide the side railings. Each of the horizontally extending railings 41 terminate in one end with an elbow 43. Depending from each of these elbows 43 is a short tubular member 44 which in turn terminate in downwardly extending generally triangularly shaped ears 45. The said ears 45 are detachably secured by pull release pin means 46 to an upstanding plate 47 which terminate upright vertical standards 17. There is a second removable pull release pin 52 for each side. These release pins are similar as set forth in regard to the removable pull release pin and ring utilized in securing the aforementioned braces 19 of the platform 11. A horizontally tubularly disposed member 50 connects the two standards 17, thereby strengthening the structure considerably.

Additionally, the said standards have a pair of short horizontally disposed tubular stubs extending perpendicularly to the standards approximately equidistantly. The stubs are displaced vertically so that one 51 extends from both of the bottommost portions of the standard 17 opposite to the ears 18. The other stubs 49 extend from the standard 17 at a juncture vertically displaced below clamp carrying member 60 for a dimension whereby it will be sufficiently below the trim of a conventional windowsill as shown by dotted lines in FIG. 2. Each of the stubs have a platen 53 and resilient cushion pads 54 affixed thereto.

On the other hand, the clamp carrying members 60 are adapted and constructed to extend over the windowsill into a room as more particularly shown in FIG. 2. A gross adjustment, to account for the width of the wall under the windowsill, is made by having one leg 56 of an L-shaped member 57 positioned in a telescoping manner into the clamp carrying member 60 which has a tubular construction for this purpose. This leg 56 has a series of longitudinally displaced bores 55 anyone of which can be aligned with aligned apertures 58 in the tubular construct of the clamp carrying member 60. A removable pin or bolt 59 is passed through the said bores 55 on the said leg 56 and through the said apertures 58. Note that in FIG. 2 the pin is located in the closest position possible.

The end portion 61 of the other leg 62 of the L-shaped member 57 has a horizontally disposed bore 63 which is suitably threaded to accept a screw member 64. One end of which carries a manipulative handle 65 while the other end carries a platen 66 carrying a resilient cushion pad 67. Clamping is effectuated between the stubs carrying the platens 53 and the pads 54 thereof, and the L-shaped member 57 carrying platens 66 and the pads 67 thereof whereby they are complementary to one another in the manner shown in FIG. 2. Clamping pressure is applied by the fine adjustment afforded by turning the handles 65.

Figure 7:
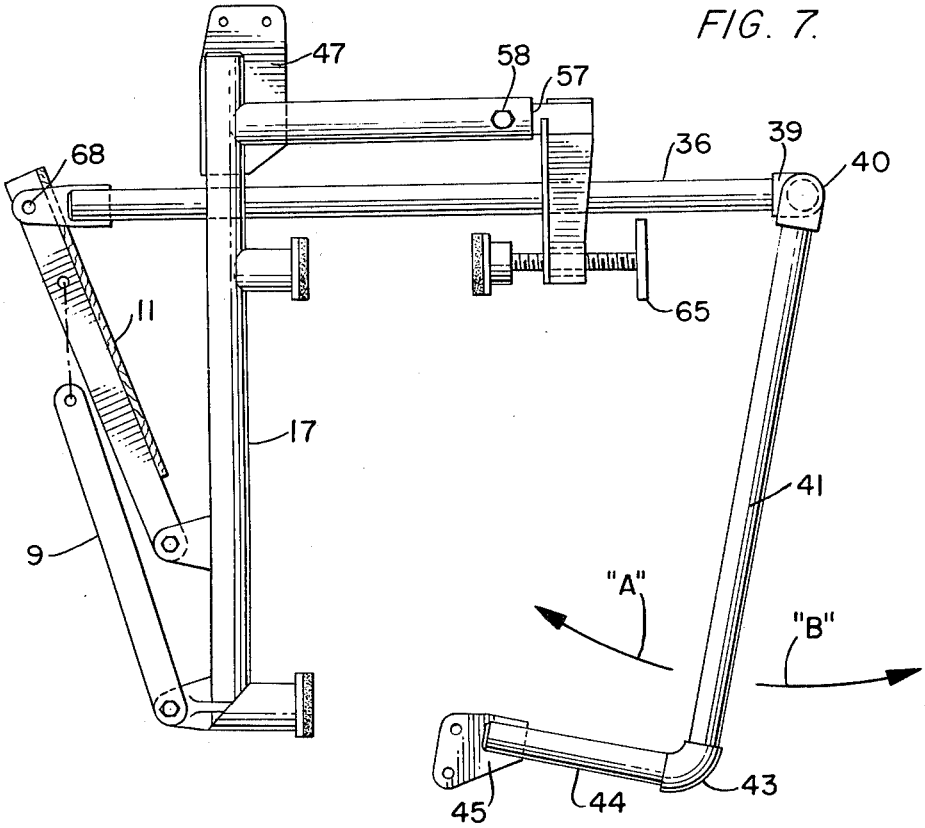
FIG. 7 is a side elevation view of the perch in an assembled manner.

The width of the perch is such that it is narrower than most conventional windows so that it may be easily placed through an open sash type window in its folded condition as exemplified by FIG. 7.

To fold the perch it is necessary to merely remove six pull pins, i.e., the two on the ends of the brace and the four on the upright standards. When this has been accomplished the platform 11 inclines upwardly about the pivotally arrangement around the rearwardly extending ears 16 of the standards 17. At the same time the railings 30 are projected forwardly and into the room as the railings pivot at 68 at the far rearward portion of the frame 12. When in the position essentially shown in FIG. 7 of the clamps may be loosened and the perch may be raised to a level whereby the bottom of the standard will clear the windowsill and the top of the standard will clear the bottom of a sash window, for instance, where both sashes have been thrust upwardly.

Of course, to conserve even more space it will be seen that the top railings may be swung upwardly in the manner indicated by the arrow in FIG. 7. With the folding of the perch it will be seen that the uprights 36 have been offset so that they will fit between the clamping carrying portions.

The perch of the present invention has been constructed so that the railings 41 may be turned counterclockwise as viewed from FIG. 7. As shown in FIG. 7, as was stated in the above, the railings are rotated clockwise in the direction of arrow "A". Arrow "B" depicts that the railings may be rotated in the opposite direction whereby it assumes a parallel position to uprights 36. The decision to rotate the railings in one direction or the other is determined by necessity of passing the perch through a window and retrieving it when necessary.

It will be seen that the construction employs many off the shelf items in order to produce a useful and inexpensive device. The construction also employs many tubular components which afford the best strength properties without unnecessary weight impediments thereby making it difficult to remove and carry the perch. The perch may be constructed of a combination of aluminum and steel materials, steel being contemplated where high stress situations occur and aluminum where no particular high stress occurs.

What is claimed is:

1. A workman support collapsible perch for attachment to a sash window whereby the workman is supported externally of said window comprising a double parallel attached together C-clamp means, a first leg of each of said C-clamp means adapted and constructed when used to be in abutting arrangement against the inside of the portion of the wall under the window, a second leg of each of said C-clamp means adapted and constructed when used to be in abutting arrangement against the outside of the portion of the wall under the window, the bridging portions between said first leg of each C-clamp means and said second leg of each C-clamp means when used adapted and constructed to be in confrontation with a windowsill, workman support platform means pivotably mounted normal when used to a terminal end portion of each of said second leg, U-shaped hand rail means when used extending horizontally from means at substantially a mating portion between each of the second legs and the said bridging portions, said rail means adapted and constructed to be demountable from said mating portions, pivotable upright means connecting the workman support platform and the rail means.

2. The perch of claim 1 wherein each of the C-clamp means are adjustable along the bridging portions between each of said first leg and each of said second leg.

3. The perch of claim 1 wherein the workman support platform includes at least one brace, the brace having one end pivotably secured to the said platform and demountably secured to the second leg of at least one of the C-clamp means.

4. The perch of claim 3 wherein the U-shaped hand rail means is attached to the said mating portions by a double pin means at the terminal portions of the legs of the rail means whereby the hand rail means are rigidly positioned when said perch is used.

5. The perch of claim 4 wherein the pivotable upright means connecting the workman support platform connects the apex portion of the hand rail means and a rear portion of the workman support platform.

6. The perch of claim 5 wherein each of the C-clamp means are adjustable along the bridging portion between each of said first leg and each of said second leg.

* * * * *